US008650750B2

(12) United States Patent
Engels et al.

(10) Patent No.: US 8,650,750 B2
(45) Date of Patent: Feb. 18, 2014

(54) PROCESS FOR ASSEMBLING A DATA CABLE CONNECTOR MODULE

(75) Inventors: Yvan Engels, Grossthiemig (DE); Ernst Klees, Munich (DE); Joachim Zellner, Rinchnach (DE); Wolfgang Schuh, Stadtprozelten (DE)

(73) Assignee: LEONI Kabel Holding GmbH, Nürnberg (DE)

( * ) Notice: Subject to any disclaimer, the term of this patent is extended or adjusted under 35 U.S.C. 154(b) by 0 days.

(21) Appl. No.: 13/325,252

(22) Filed: Dec. 14, 2011

(65) Prior Publication Data

US 2012/0178282 A1 Jul. 12, 2012

(30) Foreign Application Priority Data

Dec. 17, 2010 (EP) ..... 10195716

(51) Int. Cl.
*H01R 43/00* (2006.01)

(52) U.S. Cl.
USPC ..... 29/857; 29/876; 29/884; 439/405; 439/676

(58) Field of Classification Search
USPC ..... 29/857, 861, 874, 876, 882, 884; 439/404, 405, 417, 607.8, 607.41, 676
See application file for complete search history.

(56) References Cited

U.S. PATENT DOCUMENTS

| | | | | |
|---|---|---|---|---|
| 5,624,274 | A * | 4/1997 | Lin | 439/417 |
| 6,224,423 | B1 | 5/2001 | Yip et al. | |
| 6,287,149 | B1 | 9/2001 | Elkhatib et al. | |
| 7,182,649 | B2 * | 2/2007 | Caveney et al. | 439/676 |
| 7,195,518 | B2 | 3/2007 | Bert et al. | |
| 7,306,479 | B1 * | 12/2007 | Wu | 439/607.41 |

FOREIGN PATENT DOCUMENTS

| | | | |
|---|---|---|---|
| DE | 10 2004 004229 | A1 | 8/2005 |
| DE | 10 2004 004 229 | B4 | 2/2006 |
| EP | 0 982 815 | A2 | 3/2000 |

* cited by examiner

*Primary Examiner* — Donghai D Nguyen
(74) *Attorney, Agent, or Firm* — Roberts Mlotkowski Safran & Cole, P.C.; David S. Safran

(57) ABSTRACT

A data cable connector module with a fixation element for the positioning and fixation of the cable conductors of a multi core cable, conductor receiving units for bent IDCs, IDC receiving units for fixation of connected IDCs; a centric metallic shield star electrically conductively connected with a fixation element housing; and a contact module with a contact module metal housing, an isolation socket for the reception of bent slide circuit board contacts; at least one circuit board, a front connector face; and a fixation element connector face with at least one end isolator block guided plug-in contacts, the fixation element and the contact module being developed so that they can be brought into contact with the IDCs, causing the cable conductors of the fixation element to be electrically conductively connected with the slide contacts of the contact module; and a process for the assembly of the module to a cable.

2 Claims, 3 Drawing Sheets

PROCESS FOR ASSEMBLING A DATA CABLE CONNECTOR MODULE

BACKGROUND OF THE INVENTION

1. Field of the Invention

The invention relates to a data cable connector module for connection to a multi-core cable as well as to a process for the assembly of such data cable connector module to a cable.

2. Description of Related Art

According to the state of the art according to German Patent DE 10 2004 004 229 B4, it is known to assemble a data cable contact module to a multi-core cable. This data cable connector module connected to an assembled multi-core cable with a cable plug and a socket element presents a great advantage over the formerly necessary new installation when changing the sockets/plugs, but it is still improvable.

The present data cable connector module is rather long, because it is mainly comprised of three assembly units, a fixation element, in which the single cable conductors are fixed and arranged in a contactable spatially defined way; a sleeve element, in which the single conductors are guided shielded, and a changeable contact module with casing and with a standardized connector face.

This contact module, when connected with its fixation element, is only releasable by means of special tools, and have side contacts for the fixation element on one side and a common connection component, e.g., an RJ45 socket, as well as a sleeve element positioned in-between, on the other side. The shielding of the single cable conductors relative to each other is obtained with the data cable connector module according to the state of the art, mainly via metal plates, which are star-shaped and incorporated in the sleeve element in an isolator, in order to shield cable pairs from other cable pairs and which are part of the contact module. A continuous external shield is missing and the connection of the inner shielding plate star at the fixation element tends to exhibit radiation leakages.

Therefore, with the state of the art data cable connector module, only Cat. 7 can be achieved and it is not applicable for smaller cable channels. The discontinuous shielding is only applicable for transmission rates up to approx. 600 MHz, because radiation leakages occur and insufficient return loss for frequencies of 1 GHz and an increase of the limiting value to 10 dB are possible. Therefore, the existing data cable connector module can only fulfill requirements of Cat. 6A (ISO/IEC 11801), which corresponds to a common RJ45 type plug.

After all, the known data cable connector module can only be disconnected from the sleeve element by using special tools, when it becomes necessary to assemble a new contact module, which also results in a limited replaceability (approx. 10 pluggings). With this known data cable connector module, automatic assembly is difficult, if not impossible. Therefore, the known data cable connector module is open to improvements. Because the conductor contacts are arranged in a circle, an automatic contact is not possible (access over 360° is very difficult).

SUMMARY OF THE INVENTION

It is an object of the invention to ameliorate the disadvantages of the state of the art.

According to the invention, this object is met with a data cable connector module having the features described below as well as with a process for an automatic assembly of the data cable connector module.

The data cable connector module of the invention comprises:

- a fixation element for positioning and fixation of the cable conductors of a multi-core cable, which is positioned at one end of the cable, with:
- conductor receiving units with a conductor guide and connecting ports for bent insulation displacement contacts,
- Insulation-displacement connector (IDC) receiving units with contact openings for fixation of the connected IDCs;
- a fixation element housing;
- a centric metallic shield star, shielding each pair of conductors with respect to other conductor pairs and which is conductively connected to the fixation element housing; and
- a detachable, with the fixation element connectable, changeable contact module with:
- a contact module metal housing;
- isolator blocks arranged in the contact module metal housing for the reception of bent slide contacts with connector ends for connection to a circuit board;
- at least one circuit board between slide contacts and module plug-in contacts, which connect the slide connector ends with the module plug-in contacts for the fixation element;
- a front connector face for external connectors according to the requirements; and
- a fixation element joint connector face with module plug-in contacts guided in at least one end isolator block, whereby the fixation element and the contact module are shaped to be brought into contact establishing an electrical connection between module plug-in contacts with the IDC-contacts, so that the cable conductors of the fixation elements are in electrically conductive connection with the sleeve contacts of the contact module; enabling a surprisingly easy handling—respectively with changing of connector modules.

Generally, the fixation element is often called a "cable plug", whereas the contact module is used as a socket element, which is interchangeable by plugging according to the needs of the network.

The data cable connection module according to the invention shows better technical properties compared to known modules and a considerably simplified manufacturability and manageability.

The use of the advantageous new data cable connector modules is also possible with nets of 500≥1600 MHz, even up to over 3000 MHz (Cat. $7_A$) and the innovative data cable connector module corresponds with preparation of a suitable contact module—e.g., TERA-Cat$7_A$. The connector face may than arranged respectively (e.g., TERA or GG45).

With an advantageous design of the data cable connector module according to the invention, the fixation element as well as the contact module are polygonal and have latching elements for a reversible openable latch—e.g. with a screwdriver—, as well as respective latching elements at the contact module.

At the fixation element as well as also at the contact module one or more devices for the centering and/or for the correct adjustment of the fixation element during the insertion in the back part of the contact module can be provided. Preferably, the front connector face of the changeable contact module meets the standards ISO/EC 11801 or EN 50173.

The invention also comprises advantageous, preferably at least partially automatically operation procedures for assembly of such a data cable connection module in assembly device, at least, however, partially workable, for assembly of such data cable connector modules, with:

Production of the fixation element connected to a data cable by:

- removing the cable mantle while exposing the isolated conductors of a data cable;
- inserting the isolated conductors into conductor receiving units with IDC openings;
- inserting of the bent ends of IDC contacts into the IDC contact openings of the conductor receiving units by cutting the conductor isolation and contacting the electrical conductors;
- sliding of IDC receptors onto the free ends of the IDCs;
- providing a shield star with outer shield elements to be put between/around the IDC receptors;
- placing of the configuration into a fixation element housing.

Production of a contact module by:

- providing bent sliding contacts with connecting ends and slide contact parts;
- inserting same into an isolation holder;
- connecting at least one circuit board to the connecting ends of the slide contacts;
- connecting of connector module plug(s) with the circuit board(s) by providing an electrical connection between the slide contacts and the module plugs through the circuit boards(s);
- inserting the plugs in at least one end isolation unit and inserting the configuration into a contact module housing.

Especially because of the easy configuration of the data cable connector module with only a few components, an automatic assembly is possible without any problems.

The fixation element can be affixed easily to one cable end. To this end the cable is first stripped at its end part and brought into the fixation element housing, so that the stripped conductor ends—in this example eight conductors—protrude into the fixation element and the cable mantle ends in the strain relief of the fixation element. The stripped conductor ends are arranged in pairs around a shielded cross with outer shield—the cable ends are provided with—from opposite of the cable—isolating conductor receiving units—also called a pusher—having openings which are arranged normal to the conductor-slots for bent IDCs. The IDC contacts, on the other hand, are arranged in IDC-receiving units, which also have contact openings for module plugs. With the installation of the IDC receiving units the isolation of the conductors is cut, thus producing electrical contact with the copper conductors and the IDC. This configuration is mounted in a fixation element housing. Now, a changeable contact module housing, which e.g. is equipped with a RJ45-socket or any other connection element, can be plugged to such a fixation element, which here is provided with a screwdriver or the like, openable locking unit.

The contact module can easily be produced by inserting bent slide contacts, which have connecting ends connected with at least one circuit board, in an isolation socket followed by installation of module plugs for the fixation element to the circuit board and sliding of a module housing over it.

Due to the fact that, by the fixation element, the cable conductors can be arranged in a way that they may be plugged to the different contact modules (plugs), according to the demands, a fitting connecting element can be added or removed in an easy way without soldering or the like. Especially in case of changing the category of a network from Cat6 to Cat7, very easy modification is possible, whereby it is not necessary to lay or connect new cables in an elaborated way. Due to the fact that, compared to the known contact modules available in the market according to German Patent DE 102004004229 B4, one complete component (the sleeve element, which is used there) is left out, an advantageously shorter assembly can be achieved. Compared to the known data cable connector module, which has a shield cross in the middle, having insufficient distance to the conductors, no continuous shield and therefore no sufficient return loss, now a continuous complete shielding in the fixation element is available, which ends at the contacts of the fixation element, therefore the unshielded part of the conductors is much shorter in comparison to German Patent DE 102004004229 B4 and a significant better return loss can be achieved. The system is therefore usable for connector and network systems of higher quality EC7 resp. Cat7$_A$. With this construction technique, it is also easy to mount or dismount the connectors to or from the fixation elements without special tools, so that a simple tool with a blade will be put into the closing device and screwed with the preferred embodiment, whereby the locking between contact module and fixation element is opened. By the connector system according to the invention, inter alia, the following advantages are achieved:

- Simple conversion from RJ45 to Cat.7$_A$ components, possibly by a better shielding in the fixation element
- Easier automatic and manual attachment, because of less parts
- Construction without cutting tools
- Easy to open without special tools, when disassembly is desired,
- Applicable for smaller cable channels than possible up to now, and therefore, a broader range of application.

Moreover, with the data cable connector module according to the invention, it will no longer be necessary to change or re-install the complete cabling, including plugs, in the case that a single front contact module is defective or if a different contact module is desired, but it is sufficient to separate the defective or undesired contact module from the fixation element in an easy and fast way and to plug a new contact module onto it.

Therefore, when changing the configuration of the connector face—e.g., in case of a necessary transition to another plug or socket type—this can be done easily without the dreaded change of the complete, permanently connected cable contact module unit as is the situation for the cable plug unit known from the state of the art. Therefore, an improved data cable connector module is provided which, in the case of damage to a single contact module, does not require the expensive, laborious and time consuming change of the complete, permanently connected cable contact module unit or cable plug unit, and which enables fast, easy and cost-efficient realization of different connector face configurations and herewith a comfortable customization of the connector face to different mating plugs.

In the following, the invention is described in more detail by means of, but not limited to, preferred embodiments in conjunction with the accompanying drawings.

DETAILED DESCRIPTION OF THE INVENTION

Figure 1:
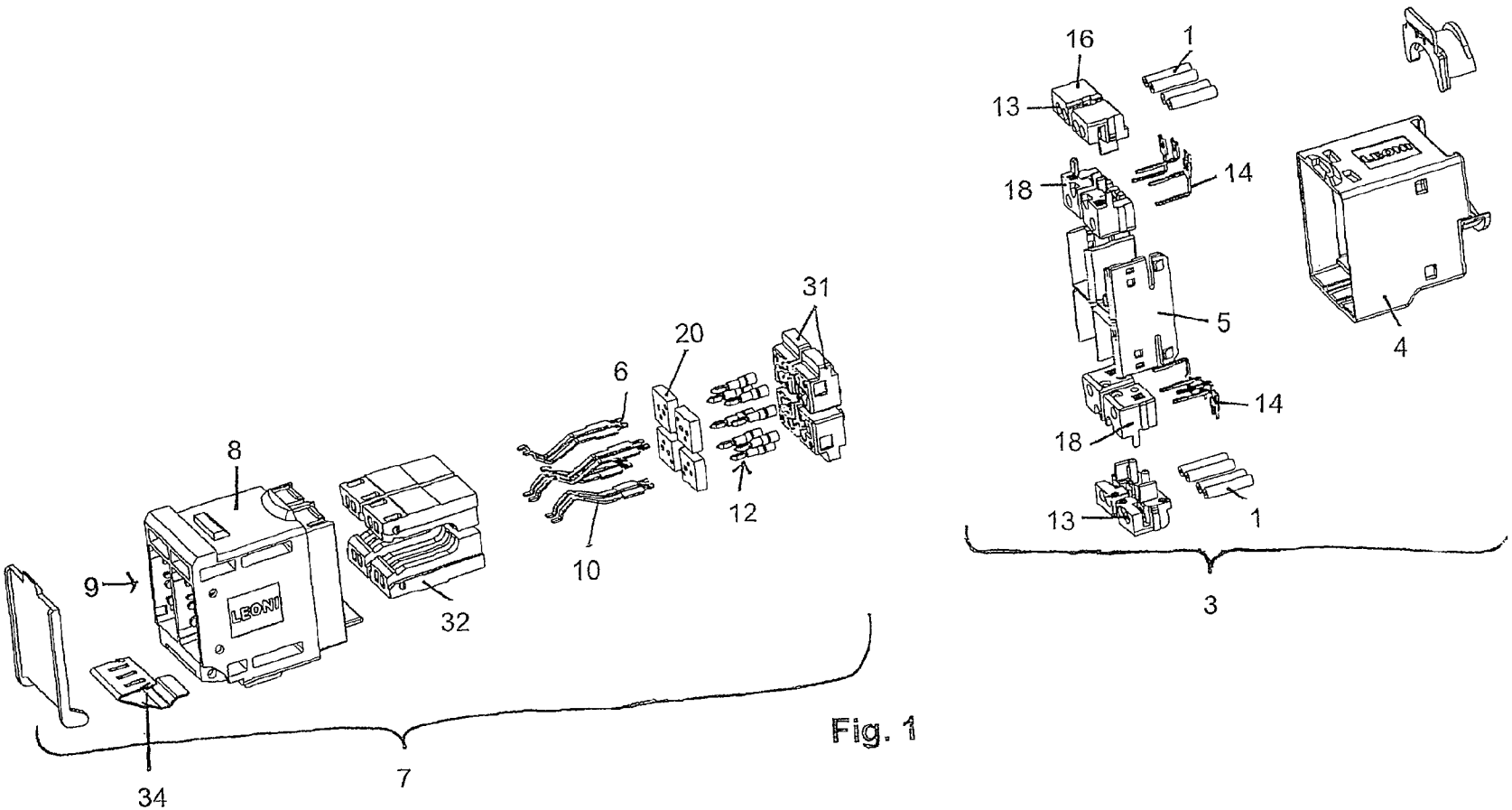
FIG. 1 is a schematic exploded view of the data cable connector module according to the invention.

As shown in FIG. 1, the data cable connector module according to the invention comprises a fixation element 3 for the positioning, separation and fixation of the conductors 1. This serves for the firm geometrical arrangement of the cable ends for plug connections. The fixation element 3 is fixed to the cable end, which has to be assembled with the data cable connector module, and comprises a fixation element housing 4 having a cable inlet, transitions between conductors and contact units as well as corresponding shielding devices 5, which shield conductor pairs relative each other, and an outer shield for the avoidance of electro-magnetic disturbances.

Furthermore, in the embodiment shown in FIG. 1, branched shielding devices 5 have lateral shield plates for positioning the passages 13 of the conductor receiving units 16, pairs of fixed cable conductors 1 and other electric conductors (insulation-displacement connectors 14, referred to as IDCs). A respective IDC receiving unit 18 for IDCs 14 is in contact with each of the conductor receiving units 16. The ICDs 14 enter through a corresponding opening into the respective conductor receiving unit 16 and are thus cut the conductor isolation to contact the respective conductor. Outside of the conductor receiving units 16, the IDCs 14 in IDC receiving units 18 are provided with contact openings for module plug-in elements 12 of pluggable modules. Around this assembly, there is arranged a fixation element housing 4, which provides an outer shield and a cable strain relief as well as, if applicable, also fixation elements for the connection of contact modules 7.

The fixation element 3 ends at its front side with the IDC receiving units 18 with contact openings, in which the module plug-in contacts 12 can be inserted.

Mounting of the fixation element 3 to the data cable can be made reversible as well as irreversible. An irreversible mounting can, e.g., be done by adhering, molding, clamping or grouting of the cable mantle with the fixation element 3.

Figure 3:
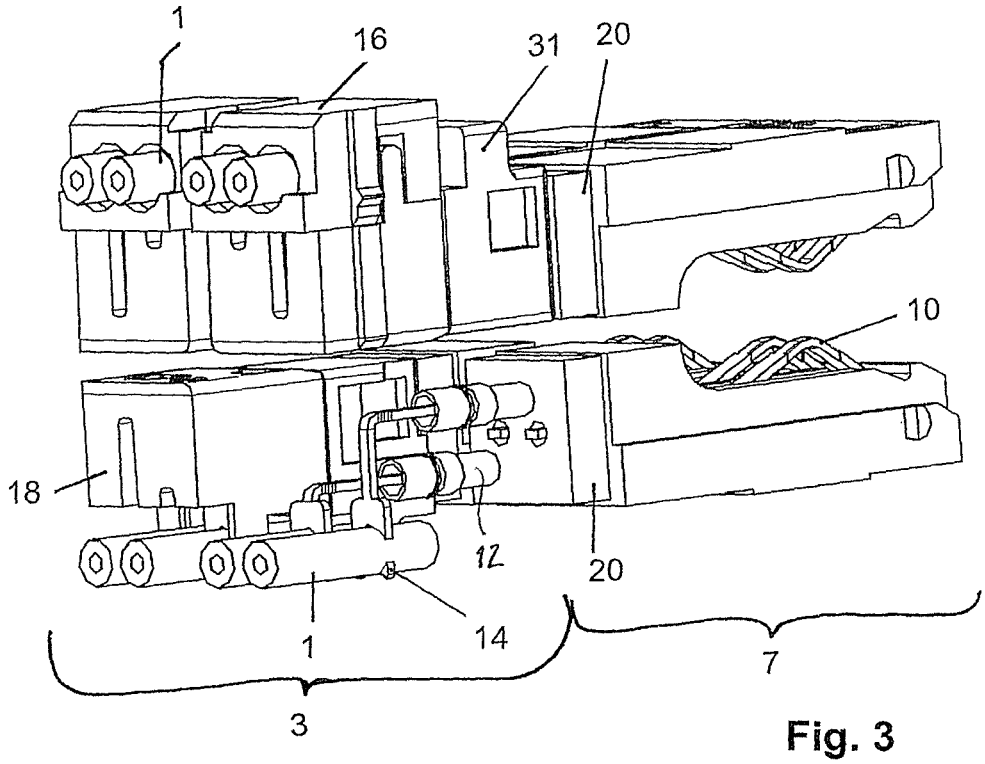
FIG. 3 is a detail of parts of a fixation element and contact module to be connected with each other.

A reversible and changeable contact module 7 mountable to the fixation element 3—as shown in FIG. 1 as a TERA connection module (TERA is a shielded twisted pair connector for use with Category 7 twisted-pair data cables and standardized by International Electrotechnical Commission (IEC) 61076-3-104 with characterized performance up to 1000 MHz, the connector having a different footprint from the more common 8P8C connector style that is also referred to by the designation"RJ-45")—has slide contacts 10 in a synthetic plastic isolator block 32, and connector ends 6 for connection to a circuit board 20. The circuit board 20 connects the slide contacts 10 with module plug-in contacts 12. The module plug-in contacts 12 are partially inserted in an end isolator block 31 that determines the geometrical arrangement thereof. The pin-shaped module plug-in contact ends, which are protruding out of the end isolator block 31, can be plugged into plug openings in the IDC receiving unit 18 of the fixation element 3 and electrically conductive connected to the IDCs, thus connecting fixation element and contact module (see, FIG. 3 where one of the conductor receiving units 16 and IDC receiving units 18 have been removed to show the interior connections).

The contact module housing 8 shown in FIG. 1 has a front socket/connector face 9 (according to TERA) which receives the electrically conductive slide contacts 10 as well as, if applicable, a holding spring 34. Preferably, the front connector face of the changeable contact module meets the standards ISO/EC 11801 or EN 50173.

Figure 2:
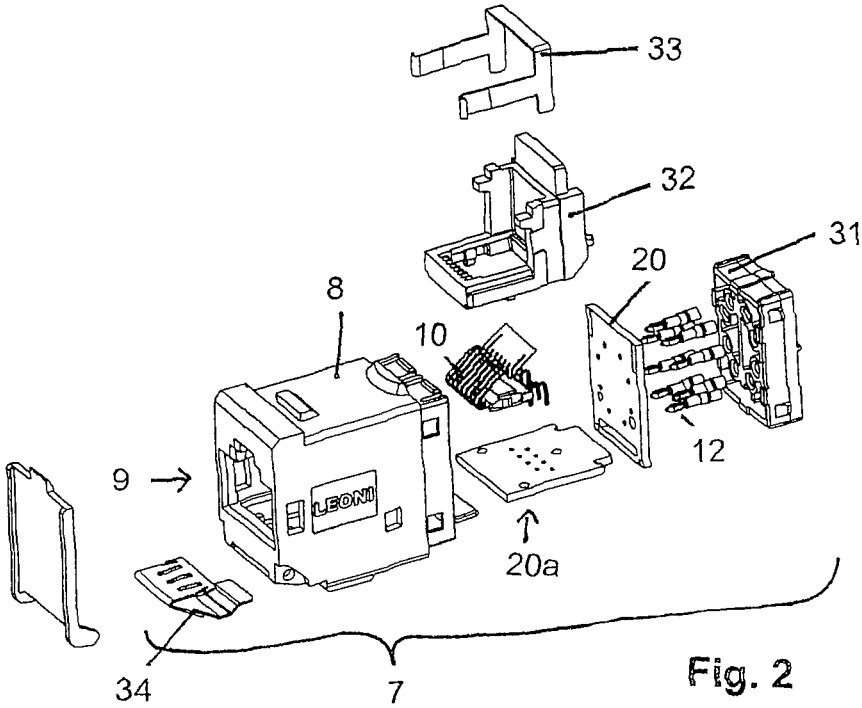
FIG. 2 is a schematic exploded view of an embodiment of the contact module for Cat.6$_A$.
Figure 5:
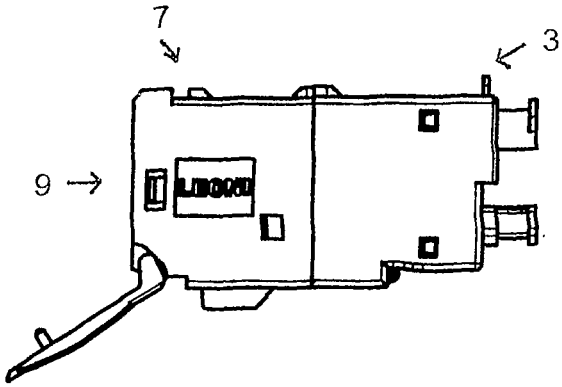
FIG. 5 is a side view of the assembled data cable connector module according to FIG. 4.
Figure 4:
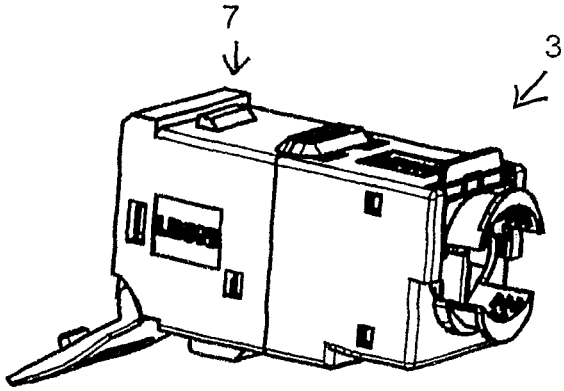
FIG. 4 is a perspective view of an assembled data cable connector module.

FIG. 2 shows a different embodiment of the contact module 7 as an RJ45 element. With the RJ45 embodiment, bent slide contacts 10 are installed on a circuit board in a way that they create a connection with the circuit board 20*a* and a second circuit board 20, and are mounted into a synthetic plastic isolator block. The circuit board 20*a* is plugged in an electrically conductive manner into the second circuit board 20, which connects the module plug-in contacts 12 of the contact module. The module plug-in contacts 12 are partly received in an end isolator block 31, which stabilizes the contacts 12 during plugging and which closes the RJ45 contact module. This configuration is enclosed in the contact module housing 8, which has, if applicable, a holding spring 34 as well as a shield clamp 33 for the synthetic plastic isolator block 32.

In the assembled condition, the ends of the module plug-in contacts 12 of the changeable contact module housing 8 are electrically conductively connected to the IDCs 14 in the IDC receiving unit 18. Normally, the fixation element is polygonal, inter alia, to achieve an easy positioning of the different plug/socket arrangements.

At the fixation element 3, one or more provisions may also be provided for centering and/or for the correct adjustment of the fixation element 3 during the plugging of the contact module 7, e.g., in the form of guide pins and fitting guiding slots.

With the automated production of the fixation element according to the invention, the cable mantle is first removed from the cable at its end and the thereby exposed cable conductors 1 are pulled into the fixation element housing 4. There, the cable conductors 1 are pulled into the conductor receiving units 16, having IDC guides, through which an IDC 14 can be connected at a right angle to the cable conductor 1 by cutting the conductor isolation. The thus connected IDCs 14 are now bent at their free ends and brought into the openings of the IDC receiving units 18, which are arranged around shield 5. Then, the plugging and connecting of a contact module 7 can be managed at the ends of the IDCs which are externally accessible through the openings in the respective IDC receiving unit 18.

A contact module 7 can also be produced automatically. At a contact module 7 according to TERA, as shown in FIG. 1 and in more detail also in FIG. 3, first the contact wires for the slide contacts 10 are inserted, correctly bent in a synthetic isolator block 32, and are thereafter inserted together with the synthetic plastic isolator block 32 into the contact module housing 8. The connector ends 6 of the slide contacts end on circuit boards 20, 20*a*. On the opposite side of the circuit boards 20 are—partially entered into the end isolation units 31—the module plug-in contacts 12. They can be plugged in the contact openings of the IDC units 14 of the fixation element 3 and can there establish a solid electrically conductive connection between the fixation element 3 and the contact module 7, without soldering or the like to a cable in a reversible way. The data cable is thereby fitted with the desired connection modules and thus a reinstallation is made easier.

RJ45 modules, as shown in FIG. 2, can be produced automatically in a similar way. Thereby, the slide contacts 10 are bent around a carrier, then inserted in a synthetic isolator block 32—if applicable, also with a compensation circuit—and connected by applying the aforesaid on a circuit board 20*a*, which is then entered into a further circuit board 20, positioned in a right angle thereto. The circuit board 20 carries the module plug-in contacts 12, partially received in a synthetic isolator block 32, like with the embodiment of the TERA-plug.

According hereto, the contact modules as well as the fixation element can be produced automatically without any problems, respectively cables can be provided with them and a significant workload for reinstallation is avoided resp. the connection safety is improved.

Though the invention has been explained based on preferred embodiments, the person of ordinary skill will recognize that the invention is in no way limited to the explained embodiments, but extends to all modifications and variations within the scope of protection of the claims.

What is claimed is:

1. Process for assembling a data cable connector module comprising the steps of:

manufacturing a fixation element connected to a data cable by:

removing of a cable mantle to expose insulated conductors of a data cable;

insertion of the insulated conductors into conductor sockets with insulation-displacement connector (IDC) openings;

insertion of bent ends of insulation-displacement connectors (IDCs) into the IDC openings of the conductor sockets so that each of the bent ends of the IDCs cuts each of the insulation of the insulated conductors and contacts each of the conductor of the insulated conductors;

pushing IDC sockets over free ends of the IDCs;

providing a shield with outer shield elements between the IDC sockets;

inserting the fixation element assembly formed of IDCs, conductor sockets, IDC sockets, and conductors produced by the preceding steps into a fixation element housing; and manufacturing of a contact module by:

preparing bent slide contacts with connection ends and slide contact areas;

insertion of the bent slide contacts into an insulation socket;

connection of at least one circuit board to the connection ends of the slide contacts;

connecting module plug-in contacts to the at least one circuit board by establishing an electrically conductive connection between the slide contacts and the module plug-in contacts by the circuit board;

insertion of plugs in at least one end insulation socket and insertion of the module assembly produced by the preceding steps in a contact module housing.

2. Method according to claim 1, wherein said steps are at least partially performed automatically.

* * * * *